US011773845B2

(12) United States Patent
Kanatani et al.

(10) Patent No.: US 11,773,845 B2
(45) Date of Patent: Oct. 3, 2023

(54) HELICAL GEAR PUMP AND HELICAL GEAR MOTOR

(71) Applicant: SHIMADZU CORPORATION, Kyoto (JP)

(72) Inventors: Kenichi Kanatani, Kyoto (JP); Takahiro Kono, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 188 days.

(21) Appl. No.: 17/428,627

(22) PCT Filed: Mar. 8, 2019

(86) PCT No.: PCT/JP2019/009492
§ 371 (c)(1),
(2) Date: Aug. 4, 2021

(87) PCT Pub. No.: WO2020/183546
PCT Pub. Date: Sep. 17, 2020

(65) Prior Publication Data

US 2022/0112894 A1 Apr. 14, 2022

(51) Int. Cl.
*F04C 2/16* (2006.01)
*F04C 18/16* (2006.01)
*F04C 15/00* (2006.01)

(52) U.S. Cl.
CPC ..... *F04C 2/16* (2013.01); *F04C 15/0026* (2013.01); *F04C 15/0042* (2013.01);
(Continued)

(58) Field of Classification Search
CPC ..... F04C 2/08–088; F04C 2/12–20; F04C 18/08–088; F04C 18/12–20; F04C 15/0026; F04C 15/0042–0049; F04C 15/0088; F04C 15/0092; F04C 29/0021–0035; F04C 29/02–028; F04C 27/006
See application file for complete search history.

(56) References Cited

U.S. PATENT DOCUMENTS

2008/0253914 A1* 10/2008 Kubota ..... F04C 29/0007 418/104
2012/0156080 A1* 6/2012 Laetzel ..... F04C 15/0042 418/206.7

FOREIGN PATENT DOCUMENTS

BR PI1011690 3/2016
CN 102362073 2/2012
(Continued)

OTHER PUBLICATIONS

"Notice of Allowance of China Counterpart Application", dated Dec. 5, 2022, with English translation thereof, p. 1-p. 6.
(Continued)

*Primary Examiner* — Laert Dounis
(74) *Attorney, Agent, or Firm* — JCIPRNET

(57) ABSTRACT

A helical gear pump includes a casing including a body (11), a front cover (12), and a rear cover (13), a pair of helical gears (23) and (24) that are housed in a hole portion formed on the body (11) and mesh with each other, and a pair of bearing cases (25) and (26) that sandwich the helical gears (23) and (24) in the hole portion. Of the helical gears (23) and (24), the number of teeth of the helical gear (23) on the driving side is larger than the number of teeth of the helical gear (24) on the driven side.

8 Claims, 11 Drawing Sheets

(52) U.S. Cl.
CPC ..... *F04C 15/0088* (2013.01); *F04C 18/16* (2013.01); *F04C 2240/30* (2013.01); *F04C 2240/50* (2013.01); *F04C 2240/60* (2013.01)

(56) References Cited

FOREIGN PATENT DOCUMENTS

| | | | | |
|---|---|---|---|---|
| CN | 105952637 | | | 9/2016 |
| CN | 105952637 | A | * | 9/2016 |
| DE | 102009012916 | | | 9/2010 |
| EP | 2406496 | | | 1/2012 |
| JP | H10502715 | | | 3/1998 |
| JP | 2002070754 | | | 3/2002 |
| JP | 2005232980 | | | 9/2005 |
| JP | 2012519799 | | | 8/2012 |
| WO | 9601950 | | | 1/1996 |
| WO | 2010102723 | | | 9/2010 |
| WO | 2014141377 | | | 9/2014 |
| WO | WO-2019072677 | A1 | * | 4/2019 |

OTHER PUBLICATIONS

"Office Action of China Counterpart Application" with English translation thereof, dated Jul. 20, 2022, p. 1-p. 13.
"Office Action of Japan Counterpart Application" with English translation thereof, dated Mar. 15, 2022, p. 1-p. 8.
"Notice of Allowance of Japan Counterpart Application," dated Jul. 12, 2022, p. 1-p. 5.
"International Search Report (Form PCT/ISA/210) of PCT/JP2019/009492," dated Jun. 11, 2019, with English translation thereof, pp. 1-2.
"Written Opinion of the International Searching Authority (Form PCT/ISA/237) of PCT/ JP2019/009492," dated Jun. 11, 2019, with English translation thereof, pp. 1-7.

* cited by examiner

HELICAL GEAR PUMP AND HELICAL GEAR MOTOR

CROSS-REFERENCE TO RELATED APPLICATION

This application is a 371 application of the International PCT application serial no. PCT/JP2019/009492, filed on Mar. 8, 2019. The entirety of the above-mentioned patent application is hereby incorporated by reference herein and made a part of this specification.

TECHNICAL FIELD

The present invention relates to a gear pump or a motor such as a hydraulic gear pump used as a hydraulic power source in various devices, and more particularly to a helical gear pump or a motor using an external gear pair including a driving-side helical gear and a driven-side helical gear that mesh with each other.

BACKGROUND ART

A gear pump includes: a pair of spur gears housed in a state of meshing with each other in a hole portion formed in a body; a driving shaft and a driven shaft for respectively fixing the spur gears; sliding contact members such as a pair of side plates in sliding contact with the side surfaces of the spur gears; a suction passage provided in a low-pressure region where the spur gears gradually separate from each other and is used for supplying hydraulic oil as a hydraulic fluid to the hole portion; and a discharge passage provided in a high-pressure region where the spur gears come into mesh and is used for discharging the hydraulic fluid from the hole portion. In place of the spur gears, a helical gear pump using helical gears has also been proposed because of their continuous tooth contact without creating closed cavity and low-noise quality due to small pulsation.

In such a helical gear pump, a large force is exerted in the thrust direction particularly on the helical gear on the driving side due to a force in the thrust direction caused by meshing of helical gears and a force in the thrust direction caused by hydraulic pressure distributed on a gear surface. In order to cope with such a force in the thrust direction, there has been proposed a gear pump or a motor, in which a hydraulic mechanism having a hydraulic chamber for pressing the shaft supporting the helical gear in a direction opposite to the direction in which the force in the thrust direction is exerted is provided on an end surface of the shaft, and hydraulic oil on a high pressure side is guided to the hydraulic chamber, so that the hydraulic mechanism presses the helical gear in the direction opposite to the direction in which the thrust force is exerted via the shaft (see Patent Literature 1).

CITATION LIST

Patent Literature

Patent Literature 1: WO 2014/141377 A

SUMMARY OF INVENTION

Technical Problem

However, in order to provide the hydraulic mechanism as described in Patent Literature 1, additional components are required, and the device configuration becomes complicated.

The present invention has been made to solve the above problem, and an object of the present invention is to provide a helical gear pump or a motor capable of reducing the magnitude of the force by which a driving-side helical gear is pressed against the sliding contact member with a simple configuration.

Solution To Problem

The invention of claim 1 is a helical gear pump or motor including an external gear pair including a driving-side helical gear and a driven-side helical gear that mesh with each other, a pair of sliding contact members on which bearing holes of a driving shaft connected to the driving-side helical gear and bearing holes of a driven shaft connected to the driven-side helical gear are formed, the pair of sliding contact members sandwiching the external gear pair from both sides, a casing configured to house the external gear pair and the pair of sliding contact members, and a high-pressure hydraulic fluid groove which is formed in an abutment region between the driving-side helical gear and a sliding contact member on a side where the driving-side helical gear is pressed in the pair of sliding contact members, the high-pressure hydraulic fluid groove communicating with a high-pressure region of hydraulic fluid in the casing, where the distance between the tooth bottom circle of the driving-side helical gear and the bearing hole of the driving shaft is set larger than the distance between the tooth bottom circle of the driven-side helical gear and the bearing hole of the driven shaft.

According to the invention of claim 2, in the invention according to claim 1, the number of teeth of the driving-side helical gear is made larger than the number of teeth of the driven-side helical gear.

According to the invention of claim 3, in the invention according to claim 1, the outer diameter of the driving shaft in the region penetrating the sliding contact member on a side where the driving-side helical gear is pressed in the pair of sliding contact members is made smaller than the outer diameter of the driven shaft.

According to the invention of claim 4, in the invention according to any of claims 1 to 3, the sliding contact member is a bearing case or a side plate.

Advantageous Effects of Invention

According to the inventions of claims 1 to 4, the action of the hydraulic fluid in the high-pressure hydraulic fluid groove formed on the sliding contact member allows the helical gear on the driving side to be pressed in the direction opposite to the direction in which the force in the thrust direction is exerted. By making the distance between the tooth bottom circle of the driving-side helical gear and the bearing hole of the driving shaft larger than the distance between the tooth bottom circle of the driven-side helical gear and the bearing hole of the driven shaft, it is possible to suppress a leakage flow of the hydraulic fluid.

According to the invention of claim 2, by making the number of teeth of the driving-side helical gear larger than the number of teeth of the driven-side helical gear, the tooth bottom seal region of the driving-side helical gear can be made large, and a leakage flow of the hydraulic fluid can be suppressed. At this time, by increasing the number of teeth of the driving-side helical gear and setting the number of teeth of the driven-side helical gear to be the same as that in the conventional art, it is possible to prevent an increase in the force in the thrust direction due to the meshing torque transmission between the driving-side helical gear and the driven-side helical gear and to prevent the entire device from becoming excessively large.

According to the invention of claim 3, by making the outer diameter of the driving shaft in the region penetrating the sliding contact member on a side where the driving-side helical gear is pressed in the pair of sliding contact members smaller than the outer diameter of the driven shaft, the tooth bottom seal region of the driving-side helical gear can be made large, and a leakage flow of the hydraulic fluid can be suppressed.

DESCRIPTION OF EMBODIMENTS

First, as a comparative example, a configuration of a helical gear pump in which a high-pressure hydraulic oil groove communicating with a high-pressure region of hydraulic oil in a casing is formed in an abutment region with a driving-side helical gear in the sliding contact member receiving a force in the thrust direction in order to press the helical gear on the driving side in a direction opposite to a direction in which the force in the thrust direction is exerted, and the driving-side helical gear is pressed in the direction opposite to the direction in which the force in the thrust direction is exerted due to the action of the hydraulic oil in the high-pressure hydraulic oil groove will be described.

Figure 8:
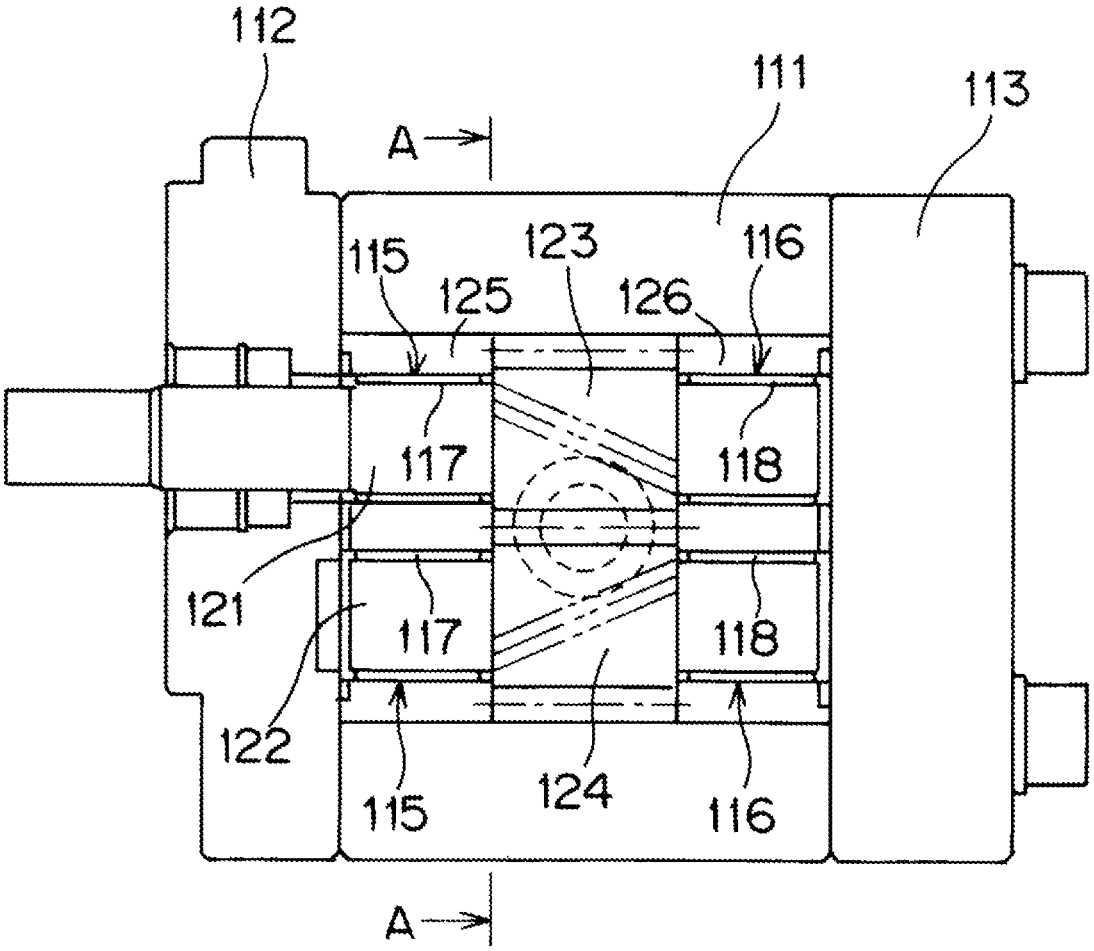
FIG. 8 is a longitudinal cross-sectional view of a helical gear pump as a comparative example.
Figure 9:
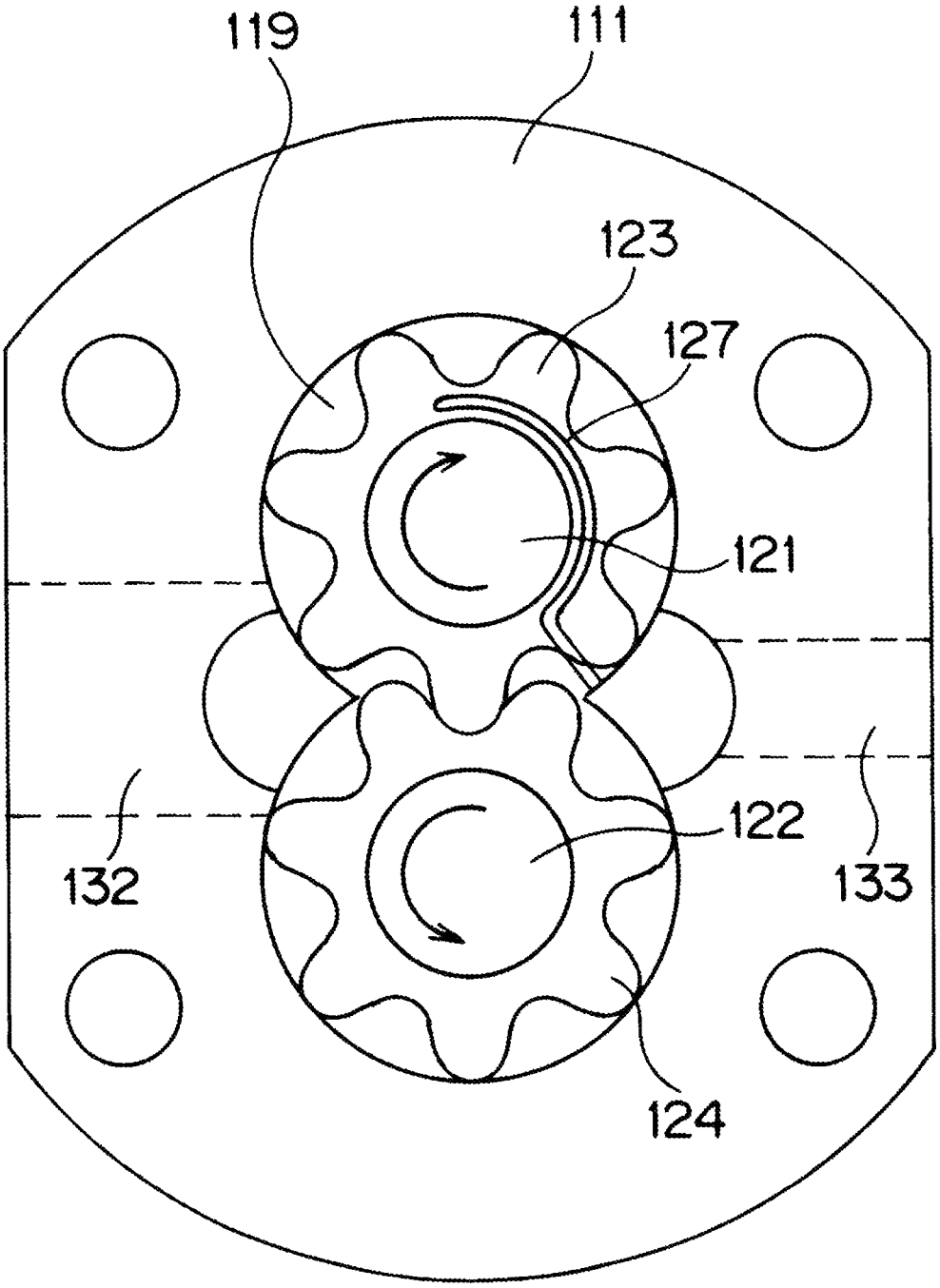
FIG. 9 is a cross-sectional arrow view taken along line A-A in FIG. 8.

FIG. 8 is a longitudinal cross-sectional view of a helical gear pump as a comparative example having such a configuration, and FIG. 9 is an A-A cross-sectional arrow view of the helical gear pump.

The helical gear pump is a helical gear pump that feeds hydraulic oil by the action of a pair of helical gears 123 and 124, and includes a casing including a body 111, a front cover 112, and a rear cover 113, the pair of the helical gears 123 and 124 that mesh with each other housed in a hole portion 119 referred to as a spectacle hole or the like formed on the body 111, and a pair of bearing cases 125 and 126 that sandwich the pair of the helical gears 123 and 124 in the hole portion 119.

The helical gear 123 is fixed to a driving shaft 121 that is rotated by driving of a motor (not illustrated). The helical gear 124 is fixed to a driven shaft 122. One ends of the driving shaft 121 and the driven shaft 122 are each pivotally supported by the bearing hole 117 formed on the bearing case 125 via a bush 115, and the other ends of the driving shaft 121 and the driven shaft 122 are each pivotally supported by the bearing hole 118 formed in the bearing case 126 via a bush 116. The helical gears 123 and 124 rotate in directions of arrows illustrated in FIG. 9 in a state of being meshed with each other by driving of the driving shaft 121.

A suction passage 132 for supplying hydraulic oil to the hole portion 119 is formed on the low-pressure region side where teeth of the pair of the helical gears 123 and 124 gradually separate in the hole portion 119 formed on the body 111. Further, a discharge passage 133 for discharging the hydraulic oil from the hole portion 119 is formed on the high-pressure region side where the teeth of the pair of the helical gears 123 and 124 gradually mesh with each other in the hole portion 119 formed on the body 111.

Of the pair of the bearing cases 125 and 126 sandwiching the pair of the helical gears 123 and 124, in an outer region of the driving shaft 121 in the bearing case 126 on the rear cover 113 side, a high-pressure hydraulic oil groove 127 communicating with a high-pressure region of hydraulic fluid in the casing composed of the body 111, the front cover 112, and the rear cover 113 is formed. In FIG. 9, the high-pressure hydraulic oil groove 127 on the back side of the helical gear 123 is illustrated by a solid line.

Figure 10:
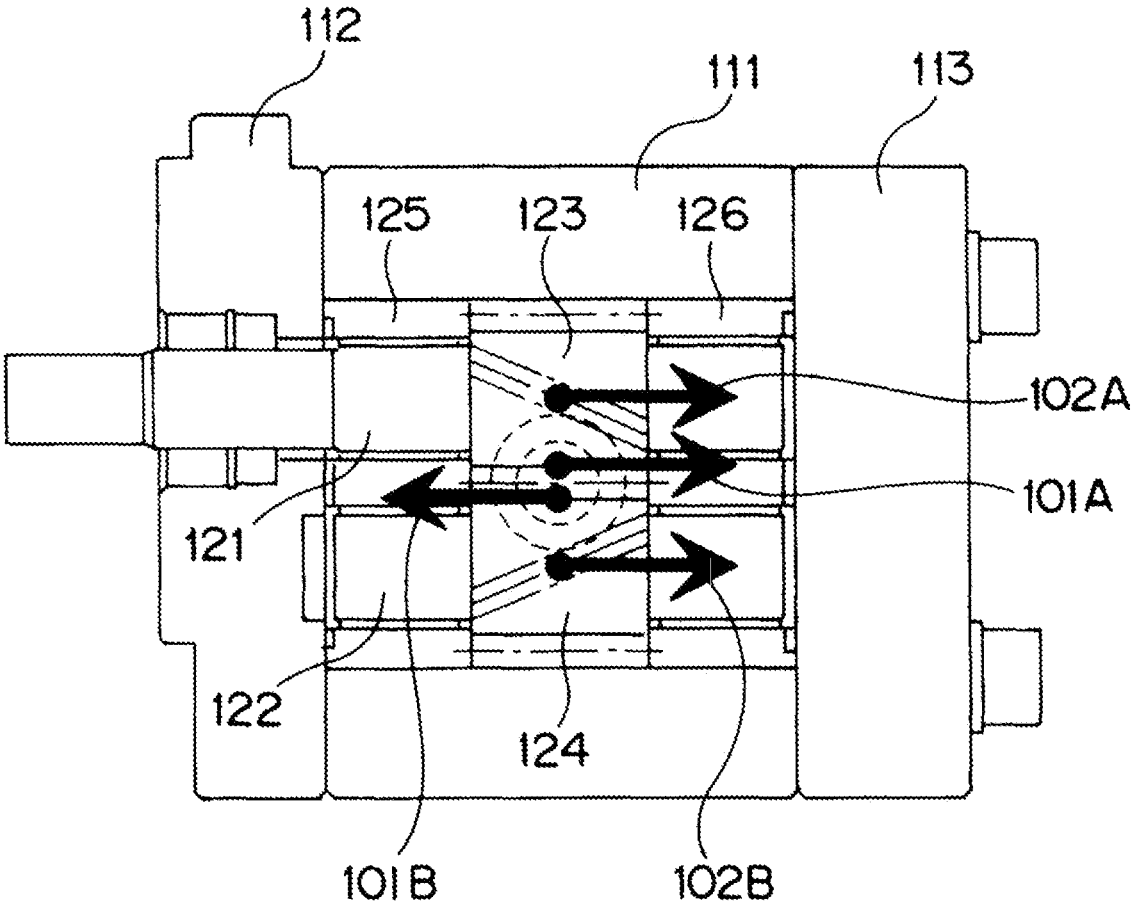
FIG. 10 is an explanatory view illustrating a force in the thrust direction acting on a pair of helical gears 123 and 124 forming an external gear pair.

FIG. 10 is an explanatory view illustrating a force in the thrust direction acting on the pair of the helical gears 123 and 124 forming an external gear pair.

As shown in the diagram, the force in the thrust direction acting on the pair of the helical gears 123 and 124 in the helical gear pump is roughly divided into forces 101A and 101B in the thrust direction by the meshing torque transmission of the pair of the helical gears 123 and 124 and forces 102A and 102B in the thrust direction by the action of the hydraulic oil fed by the pair of the helical gears 123 and 124. In the helical gear 124, the forces 101B and 102B in the thrust direction are directed in opposite directions, whereas in the helical gear 123, the forces 101A and 102A in the thrust direction are directed in the same direction. For this reason, the helical gear 123 is pressed against the bearing case 126 with a large force.

Therefore, in the outer region of the driving shaft 121 in the bearing case 126 on the rear cover 113 side, the high-pressure hydraulic oil groove 127 communicating with the high-pressure region of the hydraulic fluid in the casing including the body 111, the front cover 112, and the rear cover 113 is formed, and high-pressure hydraulic oil is supplied from the high-pressure hydraulic oil groove 127 toward the side surface of the helical gear 123. In this manner, the helical gear 123 is prevented from being pressed against the bearing case 126 with a large force.

Figure 11:
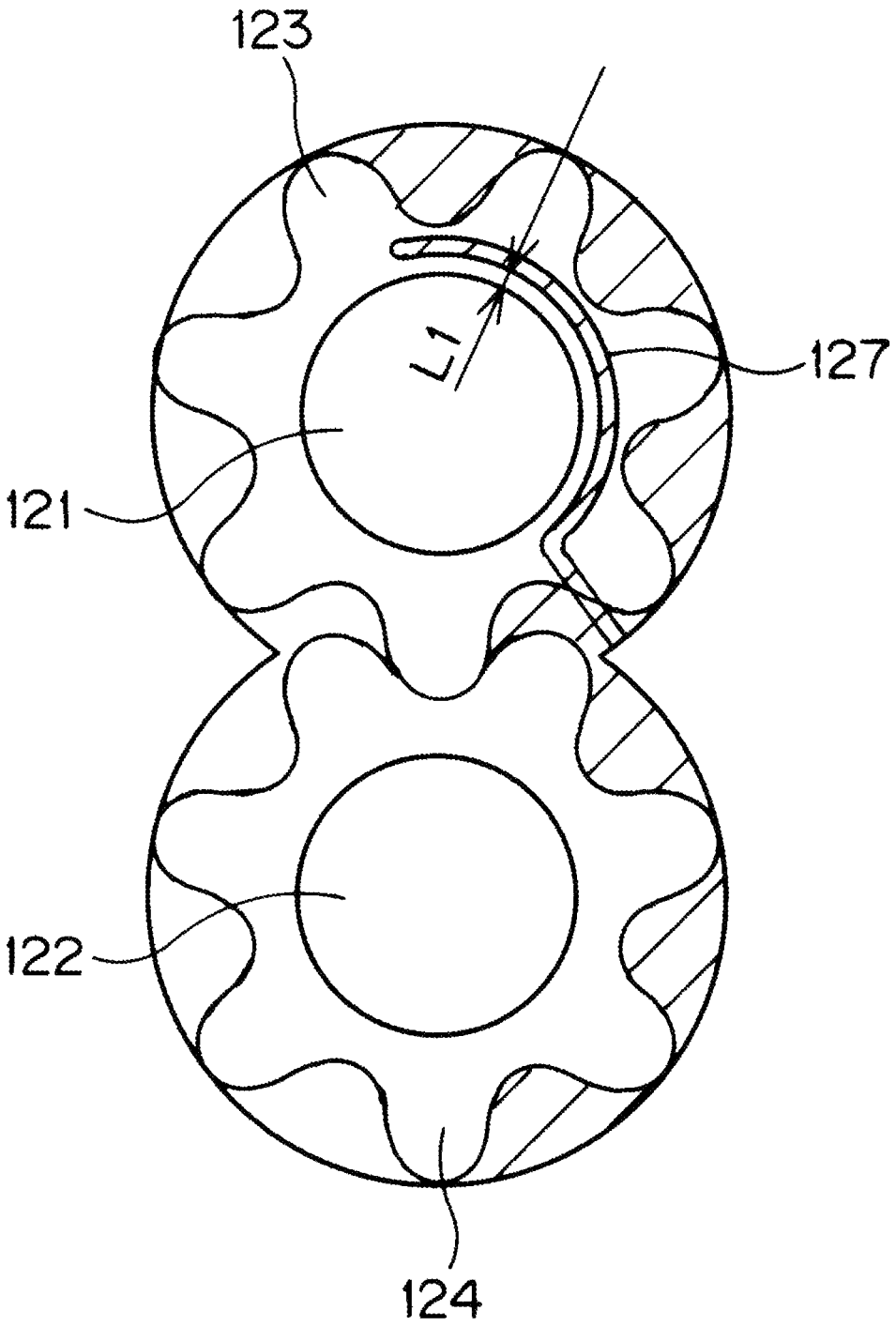
FIG. 11 is an enlarged view illustrating an arrangement relationship between a high-pressure hydraulic oil groove 127 formed in an outer region of a driving shaft 121 in a bearing case 126, the helical gear 123, and the driving shaft 121.

FIG. 11 is an enlarged view illustrating an arrangement relationship between the high-pressure hydraulic oil groove 127 formed in the outer region of the driving shaft 121 in the bearing case 126, the helical gear 123, and the driving shaft 121. Also in this diagram, the high-pressure hydraulic oil groove 127 on the back side of the helical gear 123 is illustrated by a solid line.

As hatched in FIG. 11, a region on the side where the pair of the helical gears 123 and 124 start to mesh on the side surface of the pair of the helical gears 123 and 124 is the high-pressure region. In contrast, a region of an outer peripheral portion of the driving shaft 121 and the driven shaft 122 on a side surface of the pair of the helical gears 123 and 124 is a low-pressure region. The high-pressure region and the low-pressure region are sealed by the tooth bottom seal region of the pair of the helical gears 123 and 124.

The tooth bottom seal region is a region between the tooth bottom circle of the driving-side helical gear 123 and the bearing hole 118 of the driving shaft 121 on a side surface of the helical gear 123 on the driving side. The high-pressure hydraulic oil groove 127 communicating with the high-pressure region is formed in the tooth bottom seal region. For this reason, the distance L1 (seal length) between the high-pressure region formed by the high-pressure hydraulic oil groove 127 and the low-pressure region formed by an outer peripheral portion of the driving shaft 121 becomes extremely small. In this manner, a leakage flow rate of hydraulic oil from the high-pressure region to the low-pressure region on the side surface of the pair of the helical gears 123 and 124 becomes large, which causes a problem that the feeding performance of the hydraulic oil is deteriorated.

Figure 1:
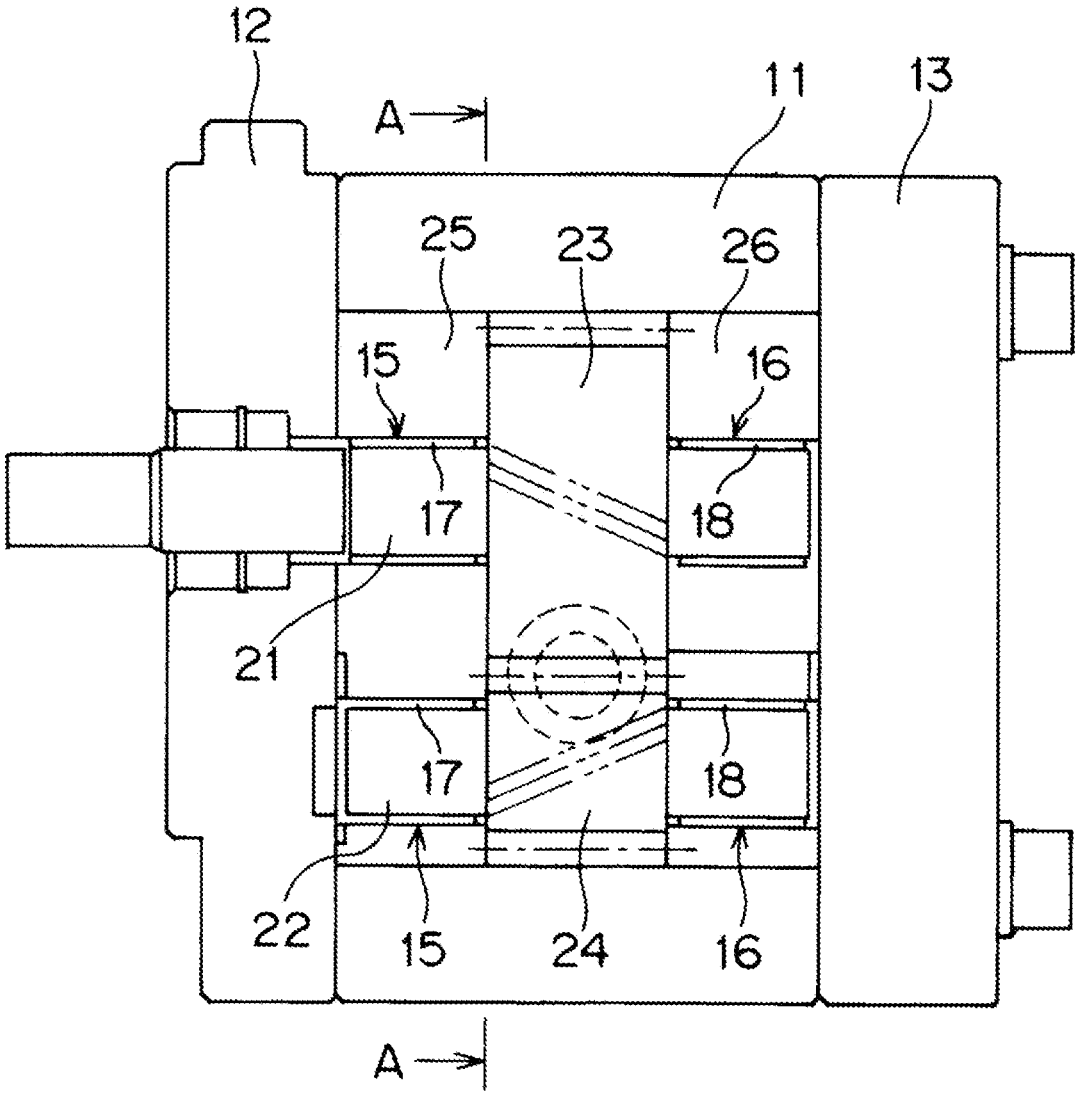
FIG. 1 is a longitudinal cross-sectional view of a helical gear pump according to an embodiment of the present invention.
Figure 2:
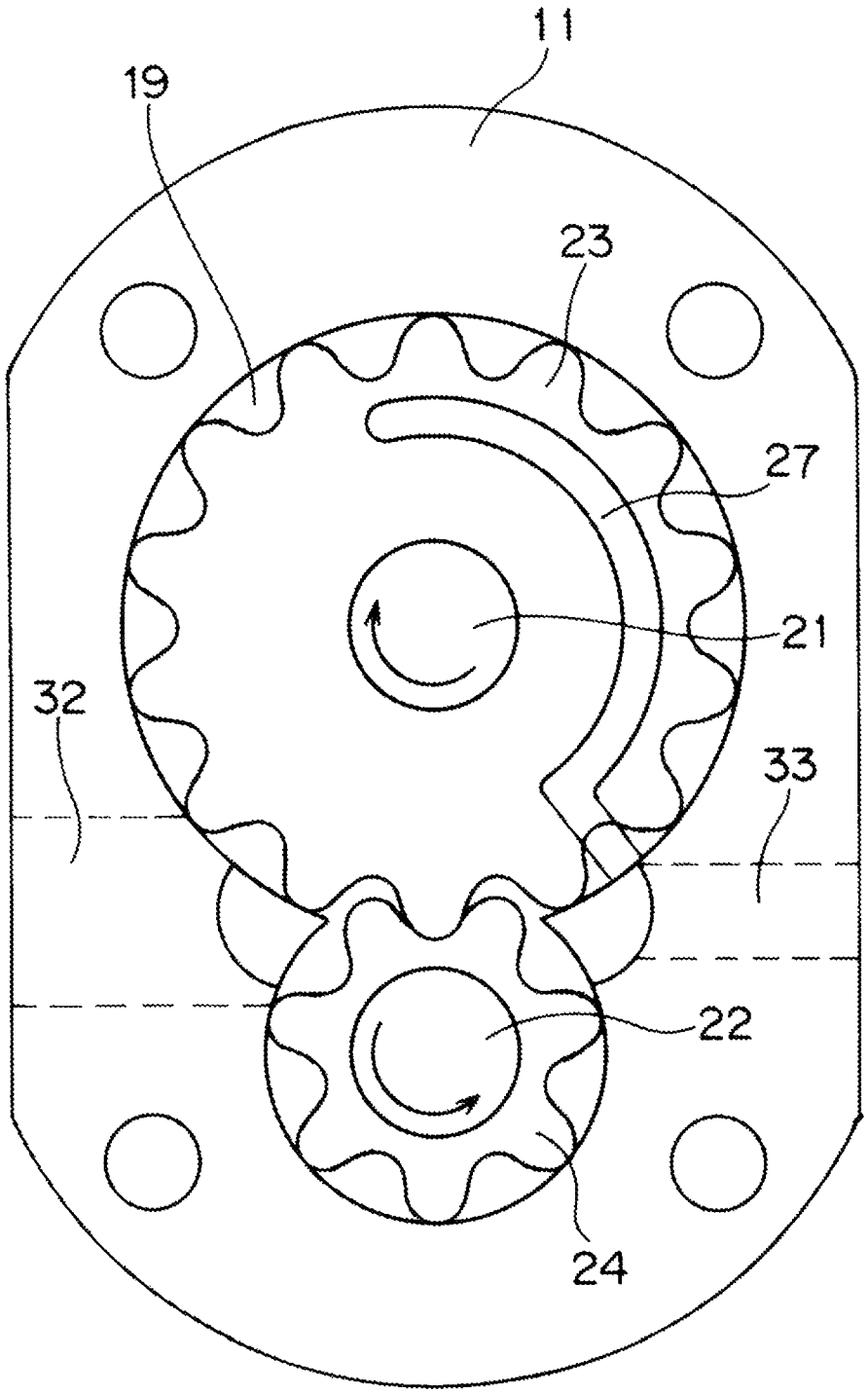
FIG. 2 is a cross-sectional arrow view taken along line A-A in FIG. 1.

Next, a configuration of a helical gear pump that solves the problem of the above-described comparative example will be described. FIG. 1 is a longitudinal cross-sectional view of a helical gear pump according to an embodiment of the present invention, and FIG. 2 is a cross-sectional arrow view taken along line A-A of FIG. 1.

The helical gear pump is a hydraulic helical gear pump that uses hydraulic oil as hydraulic fluid and feeds the hydraulic oil by the action of a pair of helical gears 23 and 24. The helical gear pump includes a casing including a body 11, a front cover 12, and a rear cover 13, a pair of the helical gears 23 and 24 that mesh with each other housed in a hole portion 19 referred to as a spectacle hole or the like formed on the body 11, and a pair of bearing cases 25 and 26, as sliding contact members, that sandwich the pair of the helical gears 23 and 24 in the hole portion 19. Of the pair of the helical gears 23 and 24, the number of teeth of the helical gear 23 is larger than the number of teeth of the helical gear 24.

The fact that the number of teeth of the helical gear 23 is larger than the number of teeth of the helical gear 24 means that the tooth diameter of the helical gear 23 is larger than the tooth diameter of the helical gear 24. That is, in a case where the helical gear 23 and the helical gear 24 mesh with each other and modules of them are the same, the tooth diameter increases as the number of teeth increases. The tooth diameter means, for example, a base circle diameter in a case where the helical gear 23 and the helical gear 24 are an involute gear. In this case, in the helical gear 23 and the helical gear 24, values obtained by dividing the base circle diameter by the number of teeth are the same.

Sliding contact means contact in a relatively movable state. That is, the sliding contact member means a member that comes into contact with the pair of the helical gears 23 and 24 in a state where the pair of the helical gears 23 and 24 are rotatable.

The helical gear 23 is fixed to a driving shaft 21 that is rotated by driving of a motor (not illustrated). The helical gear 24 is fixed to a driven shaft 22. One ends of the driving shaft 21 and the driven shaft 22 are each pivotally supported by the bearing hole 17 formed on the bearing case 25 via a bush 15, and the other ends of the driving shaft 21 and the driven shaft 22 are each pivotally supported by the bearing hole 18 formed in the bearing case 26 via a bush 16. The helical gears 23 and 24 rotate in directions of arrows illustrated in FIG. 2 in a state of being meshed with each other by driving of the driving shaft 21.

The helical gear 23 and the driving shaft 21, or the helical gear 24 and the driven shaft 22 are formed by executing cutting, polishing, quenching, and the like on a single metal member, and the helical gear 23 and the driving shaft 21, or the helical gear 24 and the driven shaft 22 are integrated. In this description, a helical gear region in these integrally formed members is referred to as the helical gear 23 or the helical gear 24, and a shaft region is referred to as the driving shaft 21 or the driven shaft 22.

A suction passage 32 for supplying hydraulic oil to the hole portion 19 is formed on the low-pressure region side where teeth of the pair of the helical gears 23 and 24 gradually separate in the hole portion 19 formed on the body 11. Further, a discharge passage 33 for discharging the hydraulic oil from the hole portion 19 is formed on the high-pressure region side where the teeth of the pair of the helical gears 23 and 24 gradually mesh with each other in the hole portion 19 formed on the body 11. Either one or both of the suction passage 32 and the discharge passage 33 may be formed in an X direction (direction perpendicular to the surface of the diagram in FIG. 2) which is the axial direction of the driving shaft 21 and the driven shaft 22.

In an outer region of the driving shaft 21 in the bearing case 26 on the rear cover 13 side, that is, the bearing case 26 on which the driving-side helical gear 23 is pressed among the pair of the bearing cases 25 and 26 sandwiching the pair of the helical gears 23 and 24, a high-pressure hydraulic oil groove 27 communicating with a high-pressure region of hydraulic fluid in the casing composed of the body 11, the front cover 12, and the rear cover 13 is formed. In FIG. 2, the high-pressure hydraulic oil groove 27 on the back side of the helical gear 23 is illustrated by a solid line.

This helical gear pump, in which, similarly to the conventional helical gear pump shown in FIG. 10, the helical gear 23 is pressed against the bearing case 26 with a large force, employs a configuration in which, in the bearing case 26 on the rear cover 13 side, the high-pressure hydraulic oil groove 27 communicating with the high-pressure region of the hydraulic fluid in the casing including the body 11, the front cover 12, and the rear cover 13 is formed, and high-pressure hydraulic oil is supplied from the high-pressure hydraulic oil groove 27 toward a side surface of the helical gear 23.

Figure 3:
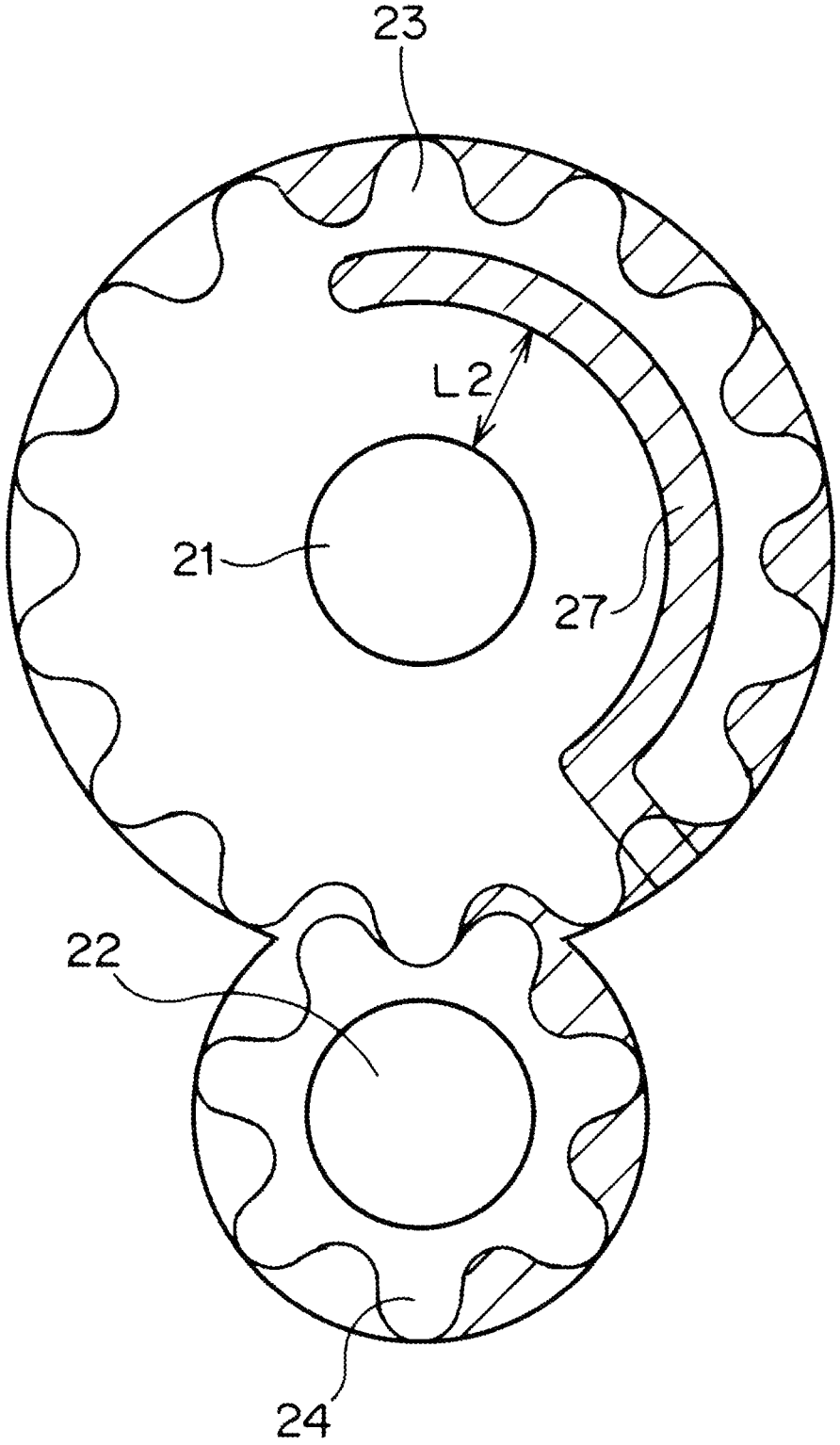
FIG. 3 is an enlarged view illustrating an arrangement relationship between a high-pressure hydraulic oil groove 27 formed in an outer region of a driving shaft 21 in a bearing case 26, a helical gear 23, and the driving shaft 21.

FIG. 3 is an enlarged view illustrating an arrangement relationship between the high-pressure hydraulic oil groove 27 formed in the outer region of the driving shaft 21 in the bearing case 26, the helical gear 23, and the driving shaft 21. Also in this diagram, the high-pressure hydraulic oil groove 27 on the back side of the helical gear 23 is illustrated by a solid line.

As hatched in FIG. 3, a region on the side where the pair of the helical gears 23 and 24 start to mesh on a side surface of the pair of the helical gears 23 and 24 is the high-pressure region. In contrast, a region of an outer peripheral portion of the driving shaft 21 and the driven shaft 22 on a side surface of the pair of the helical gears 23 and 24 is a low-pressure region. The high-pressure region and the low-pressure region are sealed by the tooth bottom seal region of the pair of the helical gears 23 and 24. The high-pressure hydraulic oil groove 27 is formed in the tooth bottom seal region of the helical gear 23 on the driving side.

Here, the helical gear 23 on the driving side has a larger number of teeth than the helical gear 24 on the driven side. The modules of the helical gear 23 on the driving side and the helical gear 24 on the driven side equally mesh with each other. In this manner, the tooth bottom seal region of the helical gear 23 on the driving side (a region between the tooth bottom circle of the driving-side helical gear 23 and the bearing hole 18 of the driving shaft 21) is an extremely large region as compared with that in the conventional helical gear pump shown in FIG. 11. For this reason, even in a case where the high-pressure hydraulic oil groove 27 is formed in the tooth bottom seal region, the distance L2 (seal length) between the high-pressure region by the high-pressure hydraulic oil groove 27 and the low-pressure region by the outer peripheral portion of the driving shaft 21 can be set large. In this manner, a leakage flow rate of hydraulic oil from the high-pressure region to the low-pressure region on the side surface of the pair of the helical gears 23 and 24 can be suppressed. In this manner, an oil groove region of the high-pressure hydraulic oil groove 27 can be set large, and the force by which the helical gear 23 on the driving side is pressed against the bearing case 26 can be easily canceled by the pressure of the hydraulic oil.

As described above, the force in the thrust direction acting on the pair of the helical gears 23 and 24 in the helical gear pump is roughly divided into forces in the thrust direction by the meshing torque transmission of the pair of the helical gears 23 and 24 and forces in the thrust direction by the action of the hydraulic oil fed by the pair of the helical gears 23 and 24. The force in the thrust direction by the meshing torque transmission does not depend on the number of teeth of the helical gear 23 on the driving side. For this reason, an increase in the force in the thrust direction due to an increase in the number of teeth of the helical gear 23 on the driving side is only due to an increase in a pressure receiving region of the hydraulic oil, and the increase in the force in the thrust direction can be sufficiently coped with by increasing the oil groove region of the high-pressure hydraulic oil groove 27.

As described above, according to the helical gear pump of the embodiment of the present invention, by making the number of teeth of the helical gear 23 on the driving side larger than the number of teeth of the helical gear 24 on the driven side, the tooth bottom seal region of the helical gear 23 on the driving side can be made large, and the leakage flow rate of the hydraulic oil can be suppressed. At this time, by increasing the number of teeth of the helical gear 23 on the driving side and setting the number of teeth of the helical gear 24 on the driven side to be the same as that in the conventional art, it is possible to prevent an increase in the force in the thrust direction due to the meshing torque transmission between the helical gear 23 on the driving side and the helical gear 24 on the driven side and to prevent the entire device from becoming excessively large.

In the above-described embodiment, the high-pressure hydraulic oil groove 27 is formed in the outer region of the driving shaft 21 in the bearing case 26 on the rear cover 13 side of the pair of the bearing cases 25 and 26. However, the high-pressure hydraulic oil groove may also be formed in an outer region of the driven shaft 22.

Figure 4:
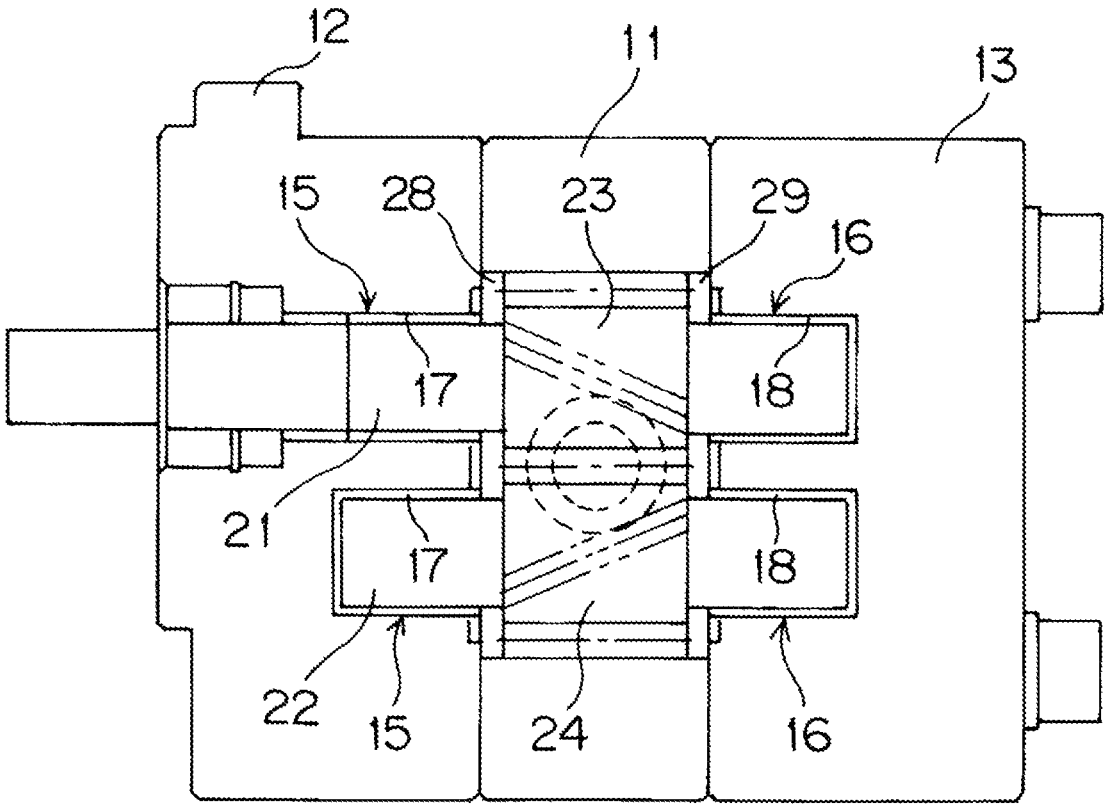
FIG. 4 is a longitudinal cross-sectional view of a helical gear pump according to another embodiment of the present invention.

Next, another embodiment of the present invention will be described. FIG. 4 is a longitudinal cross-sectional view of a helical gear pump according to another embodiment of the present invention. A member similar to that in the embodiment illustrated in FIGS. 1 to 3 is denoted by the same reference numeral, and omitted from detailed description.

In the embodiment described above, the bearing case 25 that houses the bush 15 and the bearing case 26 that houses the bush 16 are used as the pair of sliding contact members that sandwich an external gear pair including the helical gear 23 and the helical gear 24 from both sides. A configuration in which, in the bearing case 26 on the rear cover 13 side, the high-pressure hydraulic oil groove 27 communicating with the high-pressure region of the hydraulic fluid in the casing including the body 11, the front cover 12, and the rear cover 13 is formed, and the high-pressure hydraulic oil is supplied from the high-pressure hydraulic oil groove 27 toward the side surface of the helical gear 23 is employed.

In contrast, in the helical gear pump according to the present embodiment, a pair of side plates (side plates) 28 and 29 are used as a pair of sliding contact members that sandwich an external gear pair including the helical gear 23 and the helical gear 24 from both sides. A configuration in which, on the side plate 29 on the rear cover 13 side, the high-pressure hydraulic oil groove 27 similar to that in FIGS. 2 and 3 communicating with the high-pressure region of the hydraulic fluid in the casing including the body 11, the front cover 12, and the rear cover 13 is formed, and the high-pressure hydraulic oil is supplied from the high-pressure hydraulic oil groove 27 toward the side surface of the helical gear 23 is employed.

In a case where a pair of the side plates 28 and 29 are used, one ends of the driving shaft 21 and the driven shaft 22 are each pivotally supported in the bearing hole 17 formed on the front cover 12 via the bush 15, and the other ends of the driving shaft 21 and the driven shaft 22 are each pivotally supported in the bearing hole 18 formed on the rear cover 13 via the bush 16.

In the above-described embodiment, the pair of the bearing cases 25 and 26 or the pair of the side plates 28 and 29 are used as the sliding contact members. However, the configuration may be such that the pair of the bearing cases 25 and 26 or the pair of the side plates 28 and 29 are omitted, and the front cover 12 and the rear cover 13 are used as the sliding contact members. In this case, on the rear cover 13, the high-pressure hydraulic oil groove 27 similar to that is FIGS. 2 and 3 communicating with the high-pressure region of the hydraulic fluid in the casing including the body 11, the front cover 12, and the rear cover 13 is formed. However, in a case where the pair of the bearing cases 25 and 26 or the pair of the side plates 28 and 29 are used, there are advantages that leakage of the hydraulic oil from a side surface region of the external gear pair including the helical gear 23 and the helical gear 24 can be reduced, and durability of the pump can be improved.

The configuration may be such that, as the sliding contact member, one of the bearing case 25, the side plate 28, and the front cover 12 is used on one side surface of the external gear pair including the helical gear 23 and the helical gear 24, and one that is not used on the one side surface among the bearing case 25, the side plate 28, and the front cover 12 is used on the other side surface, so that they are used in a mixed manner.

Figure 5:
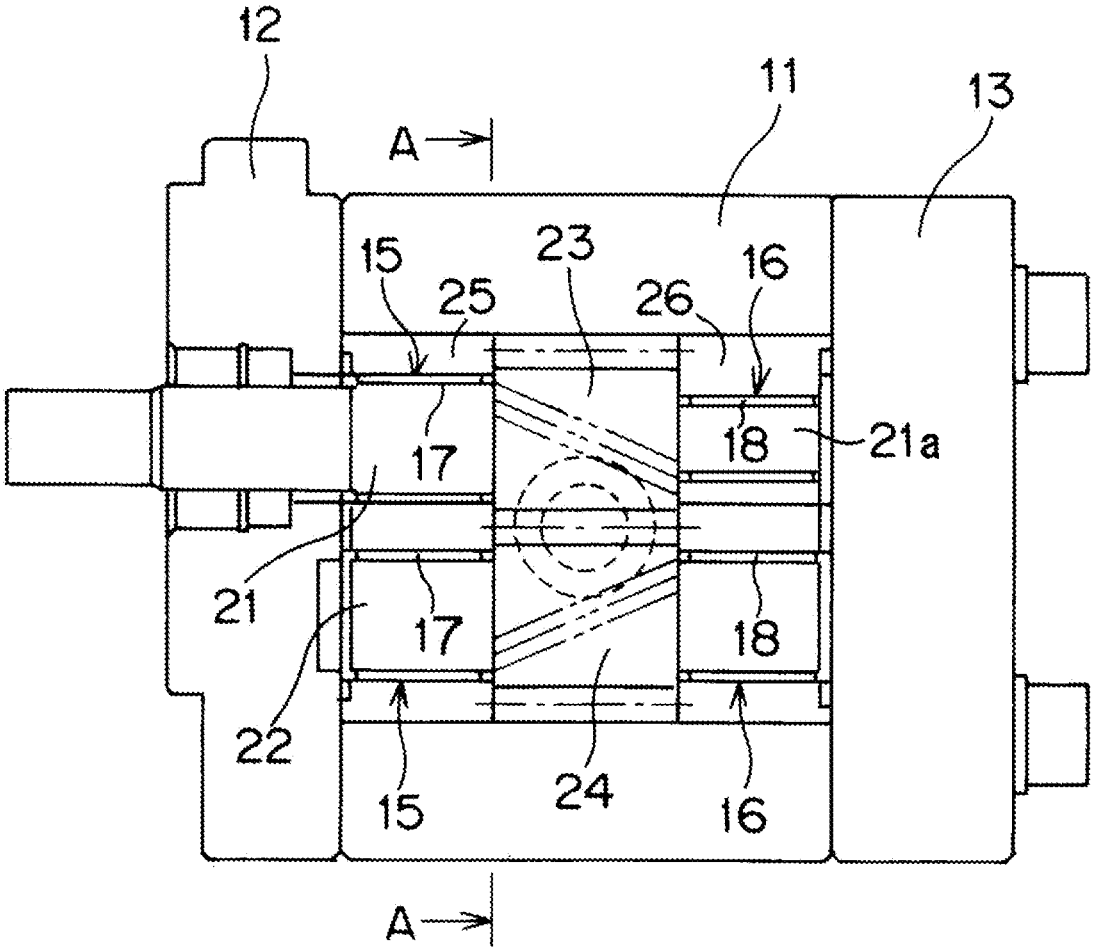
FIG. 5 is a longitudinal cross-sectional view of a helical gear pump according to still another embodiment of the present invention.
Figure 6:
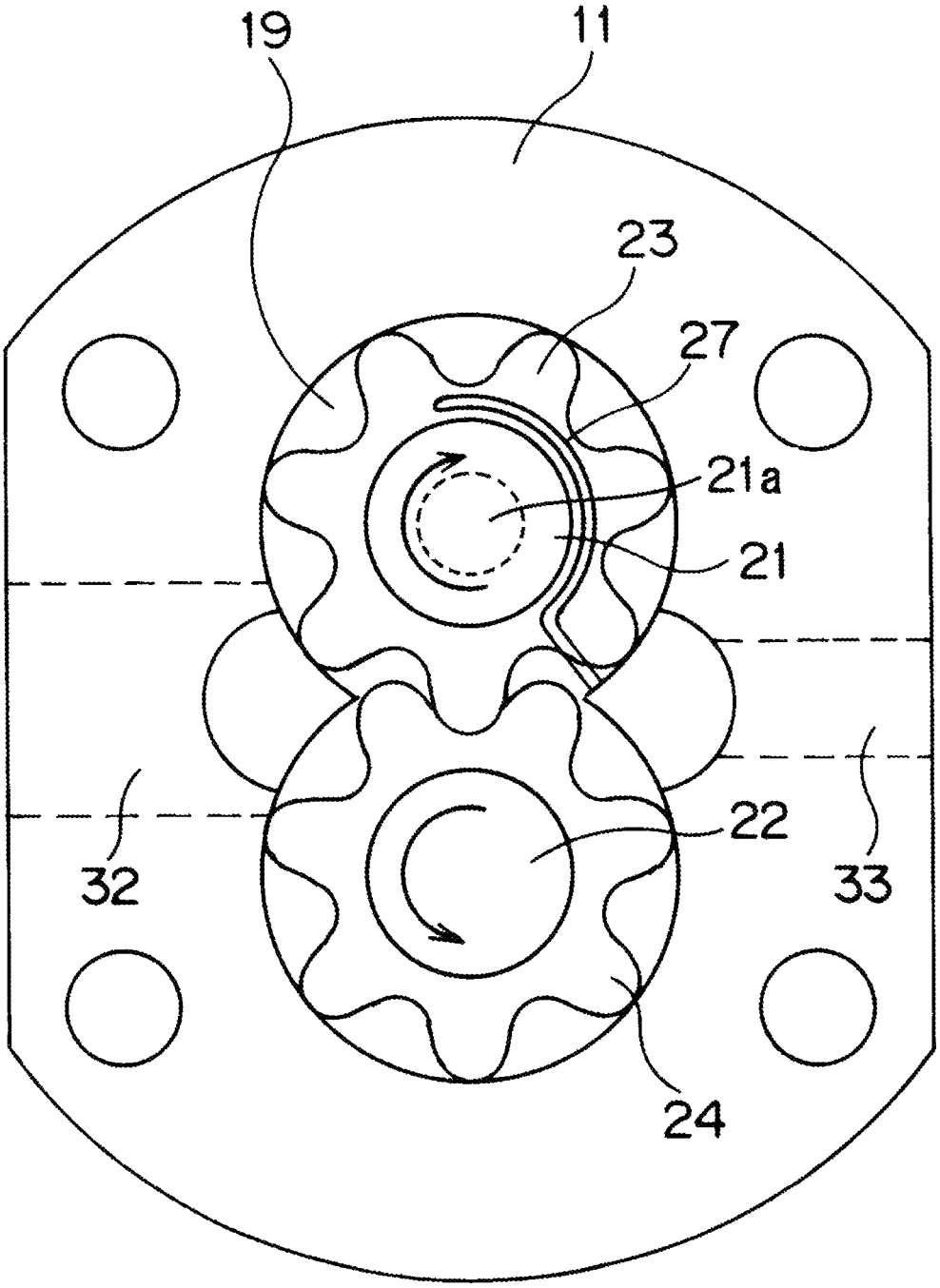
FIG. 6 is a cross-sectional arrow view taken along line A-A in FIG. 5.
Figure 7:
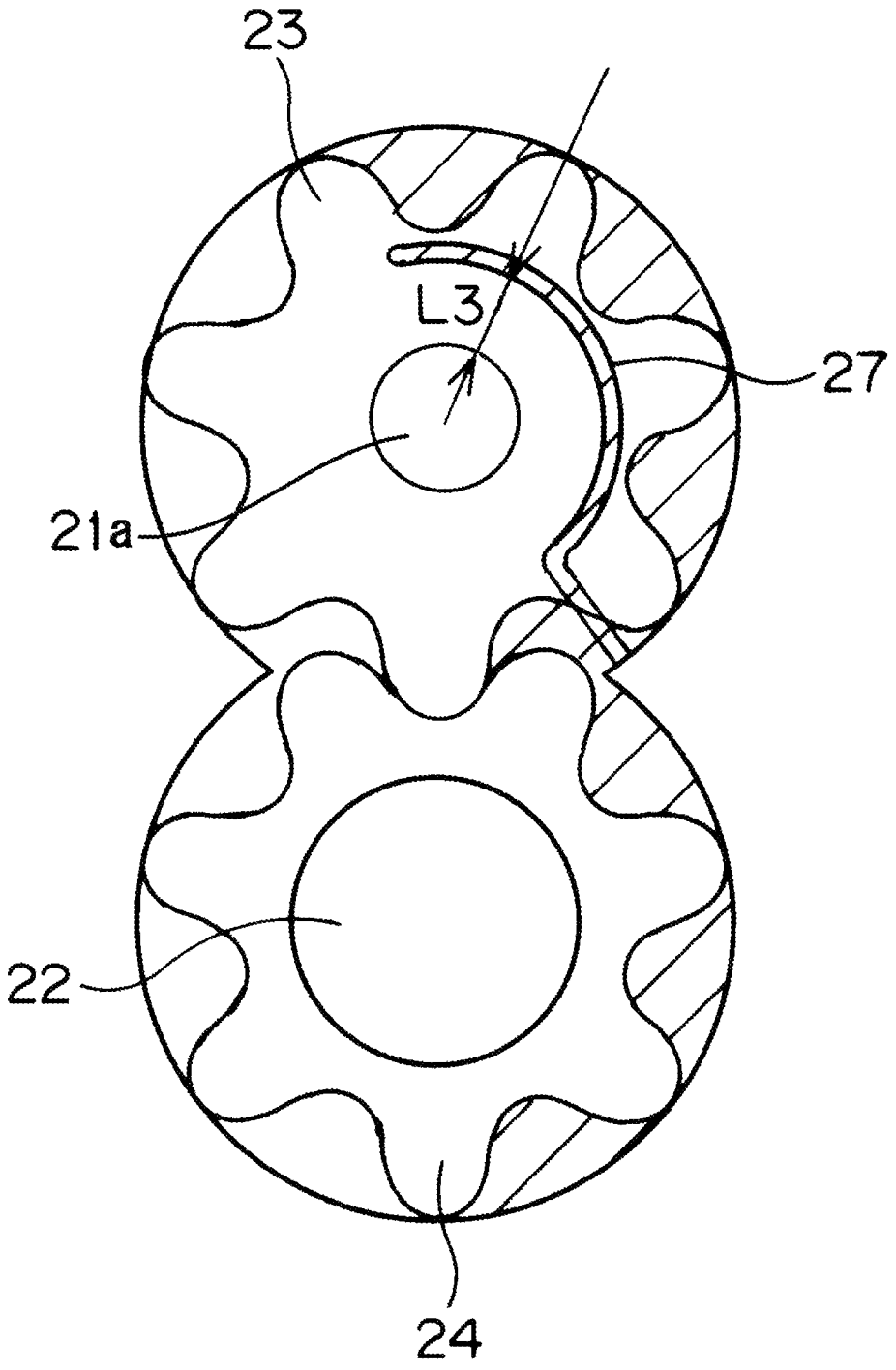
FIG. 7 is an enlarged view illustrating an arrangement relationship between the high-pressure hydraulic oil groove 27 formed in an outer region of the driving shaft 21 in the bearing case 26, the helical gear 23, and the driving shaft 21.

Next, still another embodiment of the present invention will be described. FIG. 5 is a longitudinal cross-sectional view of a helical gear pump according to still another embodiment of the present invention, and FIG. 6 is a cross-sectional arrow view taken along line A-A of FIG. 5. FIG. 7 is an enlarged view illustrating an arrangement relationship between the high-pressure hydraulic oil groove 27 formed in the outer region of the driving shaft 21 in the bearing case 26, the helical gear 23, and the driving shaft 21. In FIGS. 6 and 7, the high-pressure hydraulic oil groove 27 on the back side of the helical gear 23 is illustrated by a solid line. A member similar to that in the embodiment illustrated in FIGS. 1 to 3 is denoted by the same reference numeral, and omitted from detailed description.

In each of the above-described embodiments, by making the number of teeth of the driving-side helical gear 23 larger than the number of teeth of the driven-side helical gear 24, the distance between the tooth bottom circle of the driving-side helical gear 23 and the bearing hole 18 of the driving shaft 21 is made larger than the distance between the tooth bottom circle of the driven-side helical gear 24 and the bearing hole 18 of the driven shaft 22. In contrast, the helical gear pump according to the present embodiment employs a configuration in which the outer diameter of the driving shaft 21 in the region 21*a* penetrating the bearing case 26 on which the driving-side helical gear 23 is pressed among the bearing cases 25 and 26 as the pair of the sliding contact members is made smaller than the outer diameter of the driven shaft 22, so that the distance between the tooth bottom circle of the driving-side helical gear 23 and the bearing hole 18 in the region 21*a* of the driving shaft is made larger than the distance between the tooth bottom circle of the driven-side helical gear 24 and the bearing hole 18 of the driven shaft 22.

As indicated by hatching in FIG. 7, similarly to the embodiment illustrated in FIG. 3, the region on the side where the pair of the helical gears 23 and 24 start to mesh on the side surface of the pair of the helical gears 23 and 24 is the high-pressure region. In contrast, the region of the outer peripheral portion of the driving shaft 21 and the driven shaft 22 on the side surface of the pair of the helical gears 23 and 24 is the low-pressure region. The high-pressure region and the low-pressure region are sealed by the tooth bottom seal region of the pair of the helical gears 23 and 24. The high-pressure hydraulic oil groove 27 is formed in the tooth bottom seal region of the helical gear 23 on the driving side.

Here, the outer diameter of the driving shaft in the region 21*a* penetrating the bearing case 26 on which the driving-side helical gear 23 is pressed is smaller than the outer diameter of the driven shaft 22. For this reason, the distance between the tooth bottom circle of the driving-side helical gear 23 and the bearing hole 18 in the region 21*a* of the driving shaft can be made larger than the distance between the tooth bottom circle of the driven-side helical gear 24 and the bearing hole 18 of the driven shaft 22. In this manner, the tooth bottom seal region of the helical gear 23 on the driving side (the region between the tooth bottom circle of the driving-side helical gear 23 and the bearing hole 18 in the region 21*a* of the driving shaft) is an extremely large region as compared with that in the conventional helical gear pump shown in FIG. 11. For this reason, even in a case where the high-pressure hydraulic oil groove 27 is formed in the tooth bottom seal region, the distance L3 (seal length) between the high-pressure region by the high-pressure hydraulic oil groove 27 and the low-pressure region by the outer peripheral portion of the driving shaft 21 can be set large. In this manner, a leakage flow rate of hydraulic oil from the high-pressure region to the low-pressure region on the side surface of the pair of the helical gears 23 and 24 can be suppressed.

The embodiment illustrated in FIGS. 5 to 7 employs the configuration in which the outer diameter of the driving shaft 21 in the region 21*a* penetrating the bearing case 26 on which the driving-side helical gear 23 is pressed is smaller than the outer diameter of the driven shaft 22. However, the outer diameter of the driving shaft 21 may be smaller than the outer diameter of the driven shaft 22 in the entire region.

Each of the helical gear pumps according to the above-described embodiments can also function as a helical gear motor that exhibits a motor action of introducing high-pressure hydraulic oil from the discharge passage 33 so as to take out rotational torque from the driving shaft 21 to drive an external load, and discharging hydraulic oil having a constant pressure from the suction passage 32. That is, the helical gear pump in each of the above-described embodiments is also a helical gear motor.

Furthermore, in the above-described embodiments, hydraulic oil is used as hydraulic fluid. However, hydraulic fluid other than hydraulic oil, such as another type of liquid, fluid, or semifluid, may be used.

REFERENCE SIGNS LIST

11 . . . Body
12 . . . Front Cover
13 . . . Rear Cover
15 . . . Bush
16 . . . Bush
17 . . . Bearing Hole
18 . . . Bearing Hole
19 . . . Hole Portion
21 . . . Driving Shaft
22 . . . Driven Shaft
23 . . . Helical Gear
24 . . . Helical Gear
25 . . . Bearing Case
26 . . . Bearing Case
27 . . . High-Pressure Hydraulic Oil Groove
28 . . . Side Plate
29 . . . Side Plate
32 . . . Suction Passage
33 . . . Discharge Passage

The invention claimed is:

1. A helical gear pump, comprising:

an external gear pair including a driving-side helical gear and a driven-side helical gear which mesh with each other;

a pair of sliding contact members on which bearing holes of a driving shaft connected to the driving-side helical gear and bearing holes of a driven shaft connected to the driven-side helical gear are formed, the pair of sliding contact members sandwiching the external gear pair from both sides;

a casing configured to house the external gear pair and the pair of sliding contact members; and a high-pressure hydraulic fluid groove which is formed in an abutment region between the driving-side helical gear and a sliding contact member on a side where the driving-side helical gear is pressed in the pair of sliding contact members, the high-pressure hydraulic fluid groove communicating with a high-pressure region of hydraulic fluid in the casing, wherein a distance between a tooth bottom circle of the driving-side helical gear and a bearing hole of the driving shaft is set larger than a distance between a tooth bottom circle of the driven-side helical gear and a bearing hole of the driven shaft, wherein as compared with a case where the distance between the tooth bottom circle of the driving-side helical gear and the bearing hole of the driving shaft is equal to or less than the distance between the tooth bottom circle of the driven-side helical gear and the bearing hole of the driven shaft, a distance between a high-pressure region by the high-pressure hydraulic fluid groove and a low-pressure region by an outer peripheral portion of the driving shaft is set large.

2. The helical gear pump according to claim 1, wherein the number of teeth of the driving-side helical gear is made larger than the number of teeth of the driven-side helical gear.

3. The helical gear pump according to claim 1, wherein an outer diameter of the driving shaft in a region penetrating the sliding contact member on a side where the driving-side helical gear is pressed in the pair of sliding contact members is made smaller than an outer diameter of the driven shaft.

4. The helical gear pump according to claim 1, wherein the sliding contact member is a bearing case or a side plate.

5. A helical gear motor, being a helical gear pump according to claim 1 that exhibits a motor action.

6. A helical gear motor, being a helical gear pump according to claim 2 that exhibits a motor action.

7. A helical gear motor, being a helical gear pump according to claim 3 that exhibits a motor action.

8. A helical gear motor, being a helical gear pump according to claim 4 that exhibits a motor action.

* * * * *